United States Patent [19]

Schubert

[11] Patent Number: 4,524,754

[45] Date of Patent: Jun. 25, 1985

[54] HEATING APPLIANCE

[76] Inventor: Elliot V. Schubert, 194 Pleasant Valley St., Methuen, Mass. 01844

[21] Appl. No.: 523,182

[22] Filed: Aug. 15, 1983

[51] Int. Cl.[3] ..... F24H 3/02

[52] U.S. Cl. ..... 126/110 R; 126/110 B

[58] Field of Search ..... 126/67, 99 R, 110 R, 126/110 A, 110 AA, 110 E, 109, 118, 106, 110 B

[56] References Cited

U.S. PATENT DOCUMENTS

| | | | |
|---|---|---|---|
| 2,465,151 | 3/1949 | Dresen | 126/99 R |
| 2,568,487 | 9/1951 | Carswell | 126/110 R |
| 3,009,643 | 11/1961 | Dibert | 126/110 R |
| 3,120,225 | 2/1964 | Stark et al. | 126/110 R |
| 3,251,406 | 5/1966 | Lauer | 126/110 R |
| 4,122,999 | 10/1978 | Belcastro et al. | 126/110 R |

FOREIGN PATENT DOCUMENTS

| | | | |
|---|---|---|---|
| 724775 | 5/1932 | Fed. Rep. of Germany | 126/110 B |
| 942890 | 4/1956 | Fed. Rep. of Germany | 126/110 B |
| 1360241 | 3/1964 | France | 126/110 R |

*Primary Examiner*—James C. Yeung

*Attorney, Agent, or Firm*—Edward A. Gordon

[57] ABSTRACT

There is disclosed a heating appliance comprising an enclosed housing, a combustion chamber disposed in said housing, and a heat exchanger unit disposed within the housing upon the combustion chamber and dividing the chamber into a cool air plenum zone and a hot air plenum zone. The heat exchanger comprises a plurality of rows of spaced tubular conduits preferably having spaced heat conducting fins disposed thereon and having inlet ends communicating with the combustion chamber and through which combustion gases pass and outlet ends communicating with an exhaust manifold for conducting effluent combustion gases out of the heating appliance housing. An air intake opening is disposed in the housing adjacent the heat exchanger and the cool air plenum zone to permit movement of air into the cool air plenum zone and into contact with the heat exchangers. A hot air outlet is disposed in the housing adjacent the hot air plenum zone and communicates with the hot air plenum zone for conducting heated air from the heating appliance. It is also disclosed that the heating appliance may be provided with a plurality of heat exchangers and with blowers for moving air from the cool air plenum zone into heat exchange contact with the heat exchanger then into the hot air plenum zone and on to the unit to be heated. Also, the heat exchanger is preferably angularly disposed within the housing.

7 Claims, 7 Drawing Figures

HEATING APPLIANCE

FIELD OF THE INVENTION

This invention relates generally to heating systems such as those used in residential houses and other buildings; and more particularly to a hot air heating appliance for central or unit heating having a simplified construction and efficient operation.

BACKGROUND OF THE INVENTION

Furnace systems, such as those used in residential houses, small and large buildings, and the like, are often fueled with fuels, such as oil, coal, natural gas and the like. Such furnace systems produce combustion products as flue gases which must be disposed of in the atmosphere through flue gas ductwork. One disadvantage of such furnace systems is that such flue or combustion gases retain or otherwise have a significant amount of valuable heat, and heat-producing components, derived from fuel combustion. Unless such heat, actual or potential is recovered, it escapes to the atmosphere and reduces the overall fuel efficiency of the furnace system.

Most small heating appliances, such as oil, gas and coal house heating appliances, are relatively inefficient. Typically, an oil fired home heating appliance has a maximum efficiency of between 65 to 75 percent. This means that there is a large amount of heat energy in the exhaust flue stack gases due to inefficient extraction of heat by the primary heating appliance.

It is known for example, to interpose an auxillary heat exchanger in the flue stack of a heating appliance. Typically devices designed for this purpose pass the flue gases through plain or finned tubes. A blower or some other means is provided for moving fluid such as air over the surface of the tubing and fins to effect an exchange of heat between flue gases and the air. The heated air is then recirculated back into the primary system of the heating appliance or conducted through ducts or the like to provide secondary or even primary heating of a designed space or other area.

Examples of such heat exchangers are disclosed in U.S. Pat. Nos. 4,044,950 (Aug. 30, 1977); 4,147,303 (Apr. 3, 1979); 4,291,671 (Sept. 29, 1981); and 4,342,359 (Aug. 2, 1982).

While many devices have been suggested by the prior art to improve the efficiency of heating appliances such devices are concerned with recovery of the energy in the flue stack gases and are thus directed to auxillary devises such as heat exchangers which are interposed in the flue stack of a heating appliance. Such auxillary devices are often times complex, expensive, require substantial maintenance and are often too bulky to be compatible with space requirements.

Accordingly, a desirable object of this invention is to provide a heating appliance for central or unit heating which does not require auxillary devices such as heat exchanges for efficient operation.

Another desirable object of the invention is to provide a heating appliance which maximizes efficiency while minimizing complexity and expense.

A further desirable object of the invention is to provide a heating appliance having exhaust flue gases of reduced temperatures.

A further desirable object of the invention is to provide a heating appliance having exhaust gases of sufficiently reduced temperatures whereby such gases may be vented by simple inexpensive ducting.

Other desirable objects of the invention will in part be obvious and will in part appear hereinafter.

BRIEF SUMMARY OF THE INVENTION

In accordance with the foregoing desired objects, the heating appliance of the present invention comprises a housing which encloses a combustion chamber having a fuel burner disposed therein. The combustion chamber and fuel burner are preferably elongated. One or more heat exchanger units are attached to the upper portion of the combustion chamber. The heat exchanger units each comprise a plurality of preferably flat tubular conduits which communicate with the combustion chamber and have a plurality of fins disposed about the tubular conduits to facilitate conduction of heat. The heat exchanger units are preferably angularly disposed with respect to the combustion chambers within the housing to increase heat conduction and as positioned define a cold air plenum zone below the exchanger units and defines a hot air plenum zone above the exchanger units. In one embodiment a blower or blowers are provided to move air from the cold air plenum zone into contact with the heat exchanger units and on to the hot air plenum zone and out an outlet to a unit to be heated. An exhaust manifold is attached to the upper ends of each heat exchanger units to exhaust the combustion gases which pass from the combustion chamber up through the tubular conduits of the heat exchangers to the manifolds. The air blowers are conventional electric motor driven and are preferably provided with associated baffles for directing a major portion of the circulating air in contact with the lower portion of the heat exchangers.

In a modified embodiment of the invention, one heat exchange unit is employed and the housing is divided into two chambers, one containing the upper portion of the heat exchanger unit and serving as a pre-heat zone, and the other chamber containing the lower portion of the heat exchanger unit and serves primarily as the hot air plenum zone.

The manifolds also serve as a collector for condensates that form as the temperature of the exhaust gases is reduced. Drains are provided for removal of the condensate.

BRIEF DESCRIPTION OF THE DRAWINGS

For a fuller understanding of the nature and desired objects of the invention, reference should be made to the following detailed description taken in connection with the accompanying drawing wherein like reference characters refer to corresponding parts throughout the several views and wherein.

DETAILED DESCRIPTION

Figure 1:
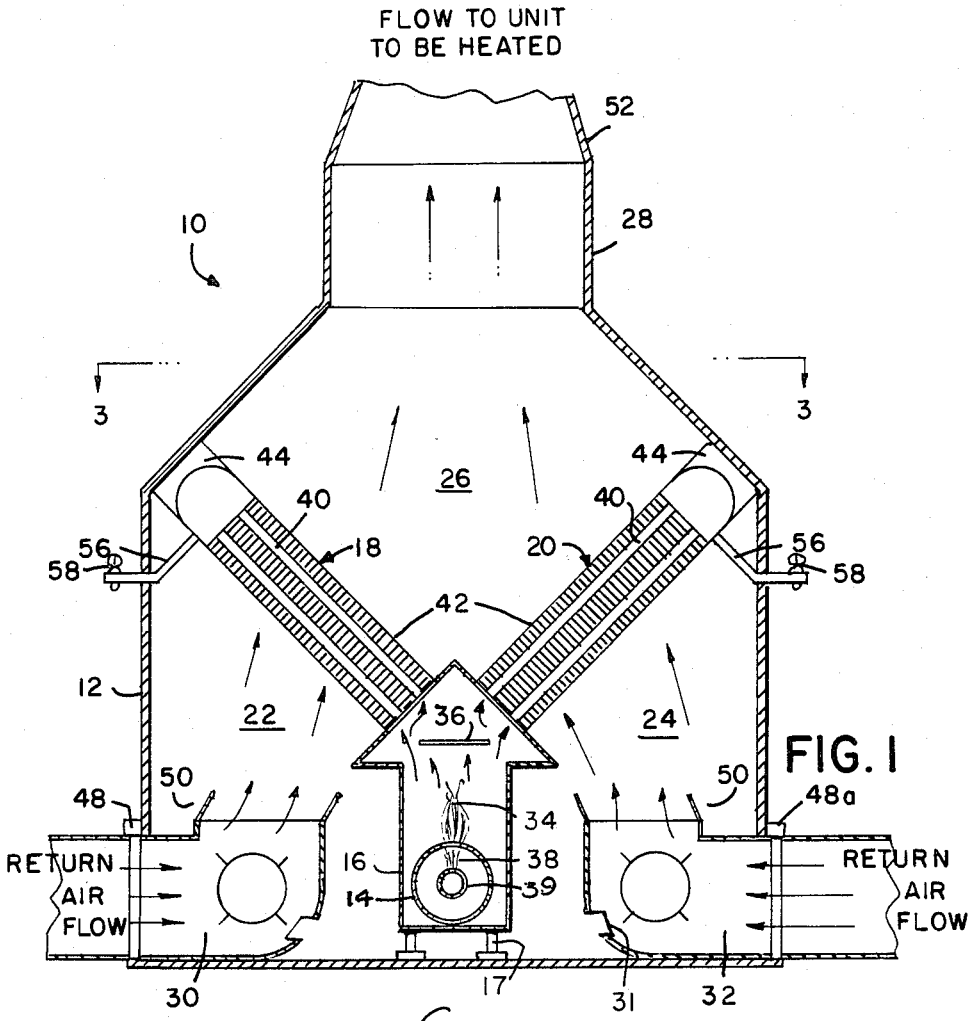
FIG. 1 is a diagrammatic, schematic partially sectional front view of one preferred embodiment of the heating appliance of the present invention.
Figure 3:
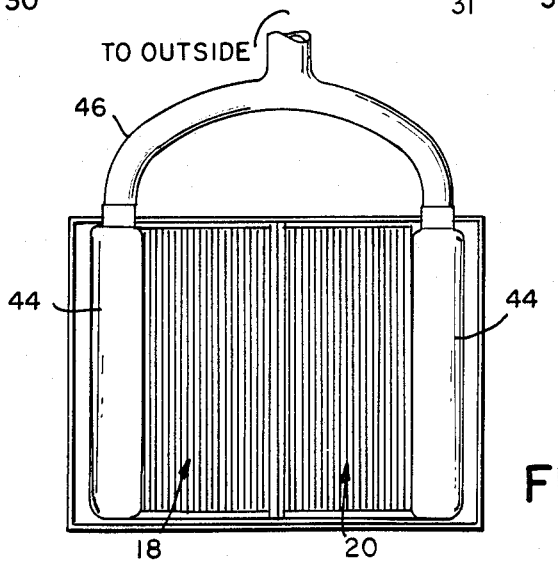
FIG. 3 is a top plan view of the heat exchange along the lines 3—3 of FIG. 1.
Figure 2:
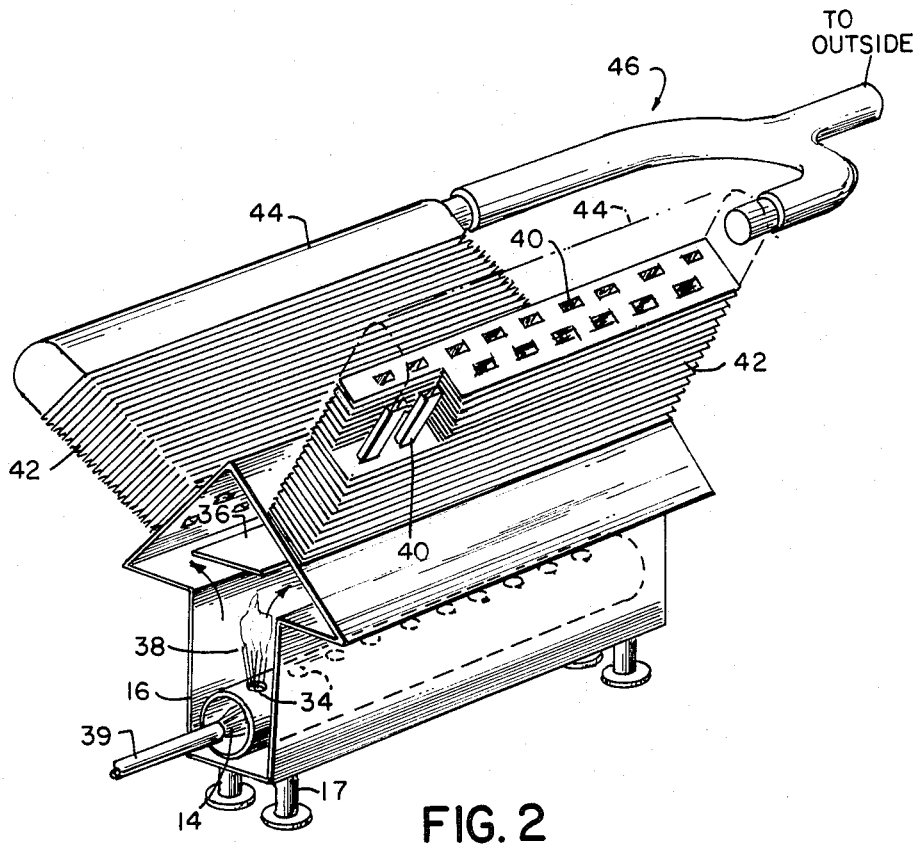
FIG. 2 is a plan view of the heat source and heat exchangers, partially broken away, of FIG. 1.

Referring now to the drawings and more especially to FIGS. 1 through 3, there is shown generally at 10 a heating appliance in accordance with the present invention having a housing 12, containing a fuel burner 14 in a combustion chamber 16, heat exchanger units 18 and 20, cold air return plenums 22 and 24, hot air plenums 26, outlet 28 and air blowers 30 and 32.

The combustion chamber 16 is preferably sealed to minimize loss of heat prior to the passage of heat through the heat exchanger units 18 and 20. The combustion chamber 16 is suitably formed of a heat resistant material such as ceramics or metals and alloys or combinations thereof well known to those skilled in the art, and is also provided with suitable supports 17.

The fuel burner 14 comprises a conduit for an injected flame 38 from a suitable external source 39 for combustion of fuel such as natural gas or oil and air, well known to those skilled in the art.

The fuel burner conduit 14 is provided with a plurality of openings 34 for egress of the flame 38. Within the combustion chamber 16 is a baffle 36 which is positioned above the flame 38 and serves to deflect the heat of combustion to the heat exchanger units 18 and 20.

The heat exchanger units 18 and 20 are mounted upon the combustion chamber 16 preferably at an angle to flow of the cool air from the cool air plenum as will be described in more detail hereinafter. The heat exchanger units 18 and 20 comprise a plurality of flat tubular conduits 40. In a preferred embodiment, the flat tube conduits are positioned in staggered arrangement or rows to provide greater contact surface for heat exchange and reduce the masking or blocking effect of positioning the conduits in a line of sight with each other. Disposed about the tubes 40 are fins 42 which serve together with tubes 40 to conduct the heat to the passing air and thereby heat it. Mounted upon the exhaust ends of each of the heat exchangers are exhaust manifolds 44 (one side being shown by dotted lines) which serve to conduct the flue gases to the flue gas outlet assembly 46. The flue gas outlet assembly (having the shape of a curved Y tube in this embodiment) conducts the flue gases to the outside or other desirable location. As will be discussed in more detail hereinafter, it is not necessary, due to low exhaust gas temperatures of the present invention, to employ the usual expensive chimney flue structure to receive and vent exhaust gases, but such chimney structure may be used if desired or convenient.

Blowers 30 and 32 preferably comprise variable speed electric motor driven blowers which are sized to force the cool return air flow up through the cool air plenums 22 and 24 and the respective heat exchanger units 18 and 20 at the desired flow rate measured in volume per unit times. The blowers 30 and 32 are mounted in an opening in the casing wall by collars 48 and 48*a*. The size of the opening in the collars is selected according to the basic requirements of the heating appliance in terms of air flow through it. It should also be noted that each blower is mounted so that air flow entering the cool air plenum is directed toward the heat exchangers. Additionally, direction baffles 50 may be provided to assist in directing the air flow so as to provide a greater rate of flow over the lower half of the heat exchanger units adjacent the combustion chamber since the temperature gradient of the heat exchangers decreases toward the exhaust manifolds. In this manner, more flow of air contacts the hotter portion of the heat exchangers. In a preferred embodiment, the heated air passes through outlet 28 through suitable ductwork 52 to the unit (not shown) to be heated. The cooled air from the heated unit is returned to the blowers 30 and 32 (as shown by the return air flow arrows) by other suitable ductwork (not shown) as is well known to those skilled in the art. Additionally, blowers 30 and 32 may be provided with openings 31 to allow a portion of the return air flow to be heated by contact with the lower portion of combustion chamber 16 prior to contact with the heat exchanger. It should be noted that the exhaust manifolds 44 are provided with means for draining away any condensate from the combustion exhaust gases. Such drainage means suitably comprise a drain tube 56 and shut off valve 58. The drainage means may be provided with a suitable receptacle or conduit (not shown) well known to those skilled in the art for disposal of the condensate.

Figure 4:
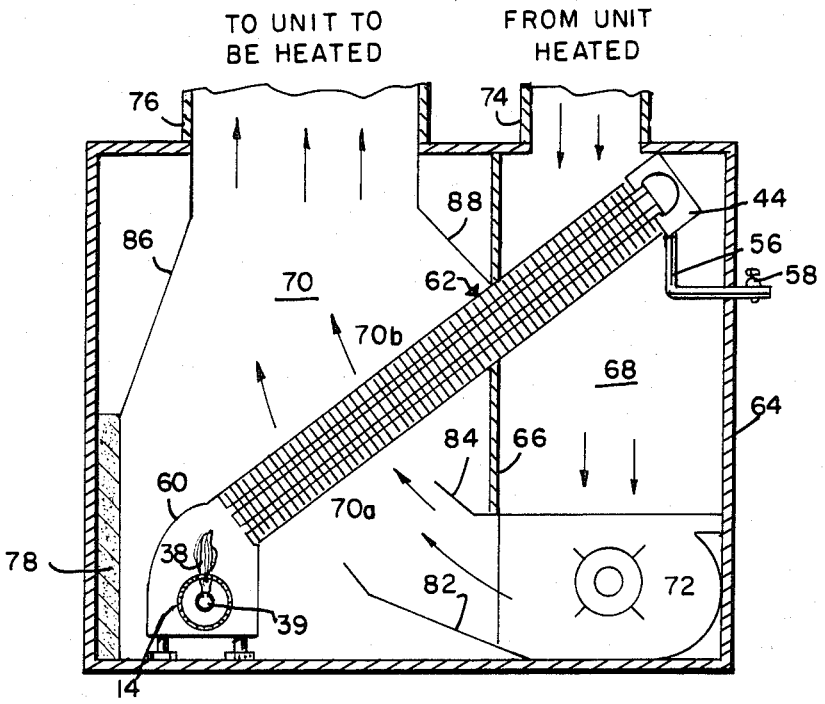
FIG. 4 is a diagrammatic, schematic partially sectional view of a modified embodiment of the heating appliance of the present invention.

Referring now to FIGS. 4 of the drawing, there is illustrated a modified embodiment of the invention. In this embodiment, the combustion chamber 60 is provided with an eliptical shape. It is to be understood that other configurations of the combustion chamber may be employed such as simi-circular, square or rectangular, the main requirement being that the heat exchanger be easily attached or formed as part thereof, at an angle and that it be capable of containing the fuel burner 14. In the embodiment of FIG. 4, only one heat exchanger unit is provided in the same manner and form as FIG. 1 including the exhaust manifold 44 and condensate drain tube 56 and valve 58.

In this embodiment, the housing 64 and partition wall 66 divide the heating appliance into two sections. One section forms a chamber 68 which encloses the upper portion of heat exchanger 62 and serves as a cool air return chamber. The other section forms a chamber 70 which encloses the lower portion of heat exchanger 62 and serves as the hot air feed chamber. A variable speed electric motor driven blower 72 is positioned in chamber 68 and sized to blow or move the air through chambers 68 and 70. The size of the blower is selected according to the basic requirements of the heat exchanger unit in terms of rate of air flow through it. The return air inlet 74 is connected to a suitable cool air return duct system (not shown) well known to those skilled in the art for conducting air returned from the unit heated. Similarly, the outlet 76 is connected to a suitable hot air feed duct system (not shown), well known to those skilled in the art for conducting heated air to the unit to be heated. The general flow of air is shown by the arrows. It should also be noted that the exhaust gases are conducted from manifold 44 via a suitable conduit or ducting to the outside or other suitable location such as a chimney flue. Auxillary fans or flowers (not shown) may be employed in association with ducting to assist in the movement of heated air to the unit to be heated and return as is well known to those skilled in the art. Also it should be noted that blower 72 may be provided with direction baffles 82 and 84 to provide a greater rate of flow over the lower portion or heat exchanger unit 62. Additional baffles 86 and 88 are preferably provided to direct the heated air to outlet 76. In operation of the embodiment of the invention illustrated in FIG. 4, cool air returning from the unit heated is preheated as it passes over the upper portion of heat exchanger 62 from the upper portion of chamber 68 to the lower portion through the operation of blower 72. The preheated air exiting from blower 72 passes through the lower portion of chamber 70, which is designated as the preheat air plenum zone 70*a*, through the lower portion of the heat exchanger 62 where it is heated and passes to upper portion of chamber 70, designated as the hot air plenum zone 70*b* and then through outlet 76 to the unit to be heated via a suitable hot air ducting system (not shown), well known to those skilled in the art. In the preferred embodiment, a high heat resistant insulating member 78 is provided to prevent the adjacent areas of the housing from becoming overheated. Various ceramic materials are suitable, as are other materials well known to those skilled in the art.

Figure 5:
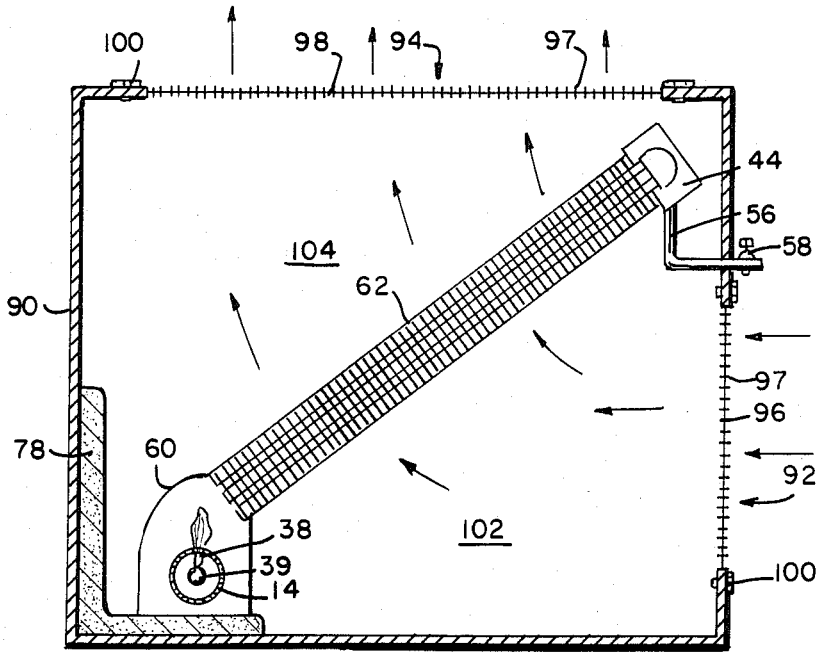
FIG. 5 is a diagrammatic, schematic partially sectional view of another embodiment of the invention.

Referring now to FIG. 5 of the drawing there is illustrated a modified embodiment of the present invention. In this embodiment, the combustion chamber 60, fuel burner 14, heat exchanger unit 62, manifold 44 drain tube 56 and drain valve 58 are the same as described with respect to FIG. 4. In the embodiment illustrated in FIG. 5, the housing 90 is provided with openings 92 and 94. In the preferred embodiment of FIG. 5, removable grills 96 and 98 are attached in openings 92 and 94 by suitable means such as bolts 100. In this embodiment, convective air entering intake opening 92 through grill member 96 is heated by conductive and radiant heat from the heat exchanger 62. The air so heated rises by convection and exits through grill 98 in outlet opening 94 to heat the surrounding area. The general flow of air is shown by the arrows of FIG. 5. In this embodiment the housing 90 defines a chamber having a lower cool air plenum zone 102 and an upper hot air plenum zone 104. Grills 96 and 98 can be provided with directional louvers 97.

Figure 6:
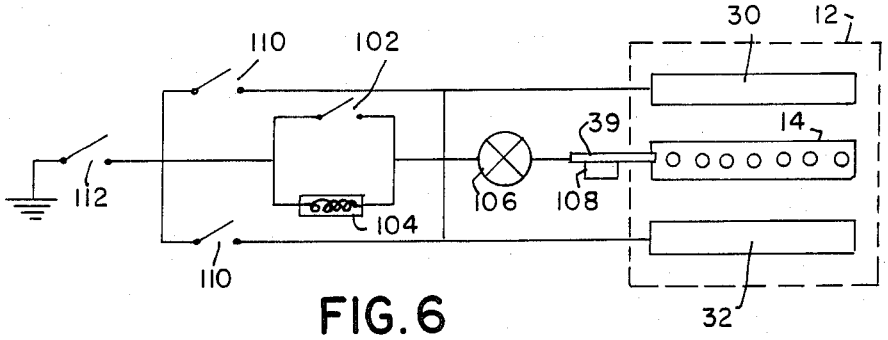
FIG. 6 is a schematic energizing diagram.

Referring now to FIG. 6 of the drawing there is illustrated schematically one example of a conventional energizing system for the heating appliance of the present invention as applicable to the embodiment of the invention shown in FIG. 1, for example. When the thermostat 102 calls for heat, the solenoid 104 activates the fuel valve 106 and the fuel burner 14 is ignited by the electronic spark igniter 108 and the blowers 30 and 32 are energized. The heated combustion gases travel up through the heat exchangers and the heat extracted by the air blown into contact with the heat exchangers by the blowers. Switches 110 permit the blowers to be operated when the master switch 112 is closed but no heating cycle is called for or only during the heating cycle when the thermostat calls for heat. It is understood that other conventional systems and circuiting may be employed which is well known to those well skilled in the art.

Figure 7:
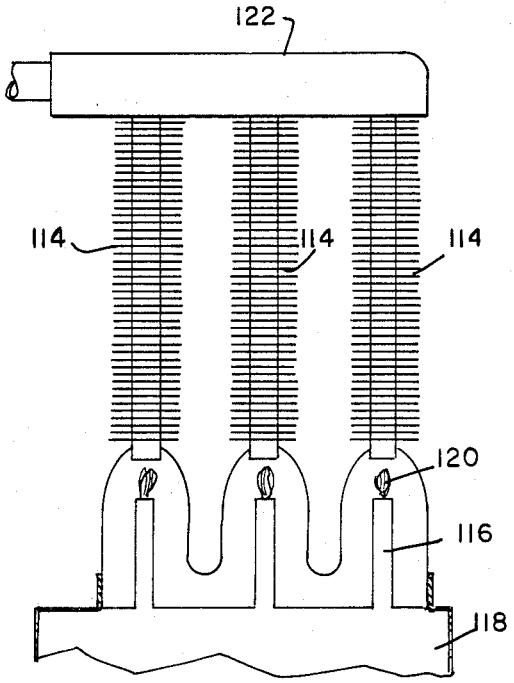
FIG. 7 is a schematic partially sectioned, partially broken view of another embodiment of the fuel burner and heat exchanger of the present invention.

Referring now to FIG. 7 of the drawing, there is illustrated another embodiment of the invention. In this embodiment a plurality of heat exchangers 114 are each heated by a plurality of fuel burner nozzels 116 which may be connected to a common source 118 of fuel 118. The flame 120 directly heats the respective heat exchangers 116. In this embodiment, a common exhaust manifold 122 may be provided.

In accordance with the present invention, there is provided an efficient heating appliance whose heat transfer characteristics can be constructed for central heating or unit heating. More especially, the present invention provides, a heating appliance in which the basic design of the heat source is efficient and comprises non-complex components. In accordance with the present invention, the primary heat source of the heating appliance, divides the combustion gases as they exit the combustion chamber into a plurality of small volumes by means of the tubular conduits of the heat exchangers. It was found that efficient heat transfer was achieved when the air to be heated was passed over the heat exchanger. Still further, it was found, that, by placing the heat exchanger at an angle and providing the tubular conduits with fins, heat transfer efficiency is further improved.

The angular position of the heat exchanger may be between 5 to 85 degrees and is preferably between 30 to 60 degrees from horizontal. It is to be understood that the heat exchangers may be used in a fully upright or 90 degree position or in a horizontal position in accordance with the present invention. These are considered less preferred embodiments. In accordance with the present invention, it was found that the temperature of combustion gases is reduced to 80 to 100 degrees F. as they leave the exhaust manifold.

In one preferred embodiment, the heat exchangers may be formed of stainless steel to improve corrosion resistance to the presence of somewhat acidic condensates which are formed when combustion flue gases cool to below the dew point, although other metals and alloys may be employed.

While the invention has been described with respect to preferred embodiments it will be apparant to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A heating appliance comprising:

an outer housing including top, bottom, and side walls and forming an inner heat exchange chamber;

an elongated combustion chamber centrally disposed within said heat exchange chamber adjacent said bottom housing wall;

said combustion chamber having chamber walls forming a lower combustion portion including a burner for the combustion of fuel and an upper combustion portion;

a pair of elongaged heat exchanger units angularly and laterally disposed within said outer housing and upon said upper combustion chamber portion and forming a generally upwardly V configuration within said inner heat exchange chamber whereby said combustion chamber and heat exchangers divide said heat exchange chamber into a pair of lower cool air plenum zones for receiving cool air to be heated and a single upper hot air plenum zone for receiving air heated by each of said heat exchange units, each of said heat exchange units comprising:

a plurality of spaced elongated tubular conduits having lower inlet openings communicating with the upper portion of said combustion chamber through which effluent fuel combustion gases pass;

upper outlet openings;

an exhaust manifold communicating with said upper outlet openings of said tubular conduits for conducting said effluent combustion gases away from said tubular conduits; and a plurality of elongated heat conducting fin members disposed in spaced vertical array about said tubular conduits from said combustion chamber to said exhaust manifold;

cool air intake openings disposed in said housing sidewalls adjacent each said cool air plenum zone;

blower means disposed adjacent said cool air intake openings to force movement of air into said cool air plenum zones, into contact with the said heat exchanger associated with each said cool air plenum zone, and into the said hot air plenum zone; and a hot air outlet opening disposed in said top housing wall communicating with said hot air plenum zone for conducting heated air from said heating appliance.

2. The heating appliance of claim 1 further comprising means disposed within the upper portion of said combustion chamber for directory effluent fuel combustion gases to each of said heat exchangers.

3. The heating appliance of claim 1 wherein said combustion chamber is hermetically sealed.

4. The heating appliance of claim 1 wherein said tubular conduits have a substantially flat configuration.

5. The heating appliance of claim 1 wherein said tubular conduits of each row are staggered relative to the tubular conduits of adjacent rows.

6. The heating appliance of claim 1 further comprising means for thermostatically operating said heating appliance in response to a predetermined temperature.

7. The heating appliance of claim 1 further comprising baffle means associated with said blower means for concentrating cool air flow across the lower portion of said exchangers.

* * * * *